US010957261B2

(12) United States Patent
Sako et al.

(10) Patent No.: US 10,957,261 B2
(45) Date of Patent: Mar. 23, 2021

(54) DISPLAY DEVICE

(71) Applicant: Japan Display Inc., Tokyo (JP)

(72) Inventors: Kazuhiko Sako, Tokyo (JP); Tsutomu Harada, Tokyo (JP); Naoyuki Takasaki, Tokyo (JP); Toshiyuki Nagatsuma, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 16/248,232

(22) Filed: Jan. 15, 2019

(65) Prior Publication Data

US 2019/0221168 A1 Jul. 18, 2019

(30) Foreign Application Priority Data

Jan. 16, 2018 (JP) ..... JP2018-004896

(51) Int. Cl.

| | |
|---|---|
| ***G09G 3/34*** | (2006.01) |
| ***G09G 3/20*** | (2006.01) |
| ***G09G 3/36*** | (2006.01) |

(52) U.S. Cl.

CPC ..... *G09G 3/3406* (2013.01); *G09G 3/2003* (2013.01); *G09G 3/2074* (2013.01); *G09G 3/3426* (2013.01); *G09G 3/3607* (2013.01); *G09G 3/3648* (2013.01); *G09G 2300/0452* (2013.01); *G09G 2310/08* (2013.01); *G09G 2320/0233* (2013.01); *G09G 2320/0238* (2013.01); *G09G 2320/0646* (2013.01); *G09G 2320/0653* (2013.01); *G09G 2360/16* (2013.01)

(58) Field of Classification Search

CPC ..... G09G 3/22; G09G 3/34; G09G 3/3406; G09G 3/3413; G09G 3/342; G09G 3/3426

See application file for complete search history.

(56) References Cited

U.S. PATENT DOCUMENTS

| | | | | |
|---|---|---|---|---|
| 2005/0206633 | A1* | 9/2005 | Mukai | G09G 3/34 345/204 |
| 2009/0167670 | A1* | 7/2009 | Peng | G09G 3/3426 345/102 |
| 2013/0215360 | A1* | 8/2013 | Pollack | G09G 3/3413 349/61 |
| 2014/0092146 | A1* | 4/2014 | Hitaka | G09G 5/10 345/690 |
| 2015/0364094 | A1 | 12/2015 | Takasaki et al. | |
| 2018/0166002 | A1 | 6/2018 | Sako et al. | |

FOREIGN PATENT DOCUMENTS

| | | |
|---|---|---|
| JP | 2016-004099 A | 1/2016 |
| JP | 2018-097203 A | 6/2018 |

* cited by examiner

*Primary Examiner* — William Boddie
*Assistant Examiner* — Jeffrey Parker
(74) *Attorney, Agent, or Firm* — K&L Gates LLP

(57) ABSTRACT

According to an aspect, a display device includes a display unit including a plurality of pixels, a light source device that emits light that illuminates the display unit, and a controller that controls operation of the light source device. The controller does not lower luminance of the light for a second predetermined time or longer after the controller has raised the luminance of the light by a predetermined amount of luminance change or more within a first predetermined time.

7 Claims, 13 Drawing Sheets

DISPLAY DEVICE

CROSS-REFERENCE TO RELATED APPLICATIONS

This application claims priority from Japanese Application No. 2018-004896, filed on Jan. 16, 2018, the contents of which are incorporated by reference herein in its entirety.

BACKGROUND

1. Technical Field

The present disclosure relates to a display device.

2. Description of the Related Art

Display devices are known (for example, in Japanese Patent Application Laid-open Publication No. 2016-004099) that perform a process called dimming. This is a process in which the intensity of light emitted from the backlight is controlled depending on the brightness of the image.

When the brightness of a part of an image is repeatedly changed between high and low levels, the conventional dimming repeatedly switches the intensity of the light between high and low levels for the entire image, which in turn changes the level of black floating, and thus the entire image appears to blink on and off. The black floating is a non-true black state on a display screen when a black image is displayed, i.e., the image still has high brightness even though the image is supposed to be black.

For the foregoing reasons, there is a need for a display device capable of restraining the change in the level of the black floating from being visible.

SUMMARY

According to an aspect, a display device includes a display unit comprising a plurality of pixels; a light source device configured to emit light that illuminates the display unit; and a controller configured to control operation of the light source device. The controller is configured not to lower luminance of the light for a second predetermined time or longer when the controller has raised the luminance of the light by a predetermined amount of luminance change or more within a first predetermined time.

DETAILED DESCRIPTION

Figure 1:
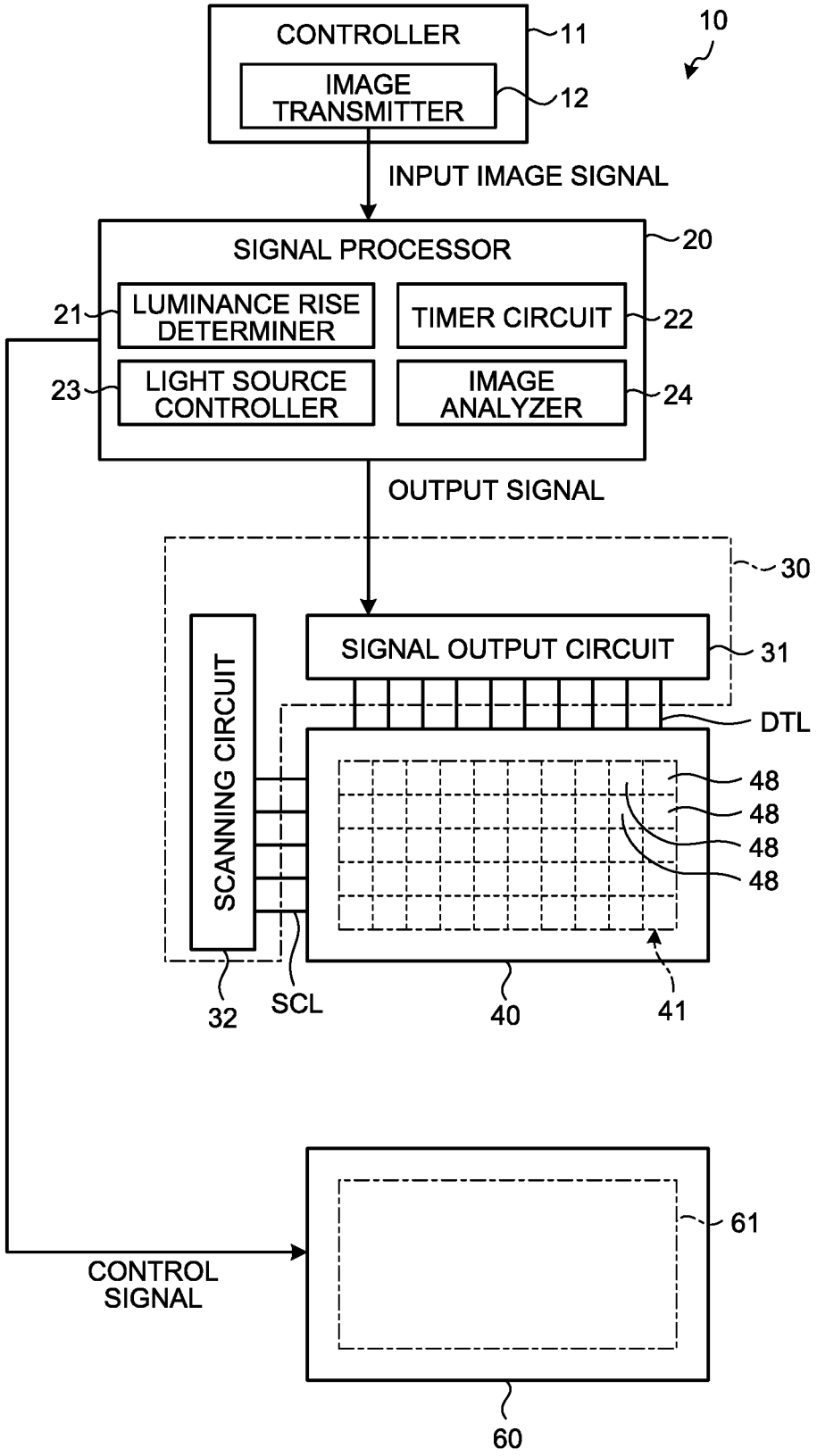
FIG. 1 is a block diagram illustrating an exemplary configuration of a display device according to a first embodiment.

The following describes embodiments of the present disclosure with reference to the drawings. The disclosure is merely an example, and the present invention naturally encompasses appropriate modifications easily conceivable by those skilled in the art while maintaining the gist of the invention. To further clarify the description, widths, thicknesses, shapes, and the like of various parts are schematically illustrated in the drawings as compared with actual aspects thereof, in some cases. However, they are merely examples, and interpretation of the present invention is not limited thereto. The same element as that illustrated in a drawing that has already been discussed is denoted by the same reference numeral through the description and the drawings, and detailed description thereof will not be repeated in some cases where appropriate.

In this disclosure, when an element is described as being "on" another element, the element can be directly on the other element, or there can be one or more elements between the element and the other element.

First Embodiment

Figure 2:
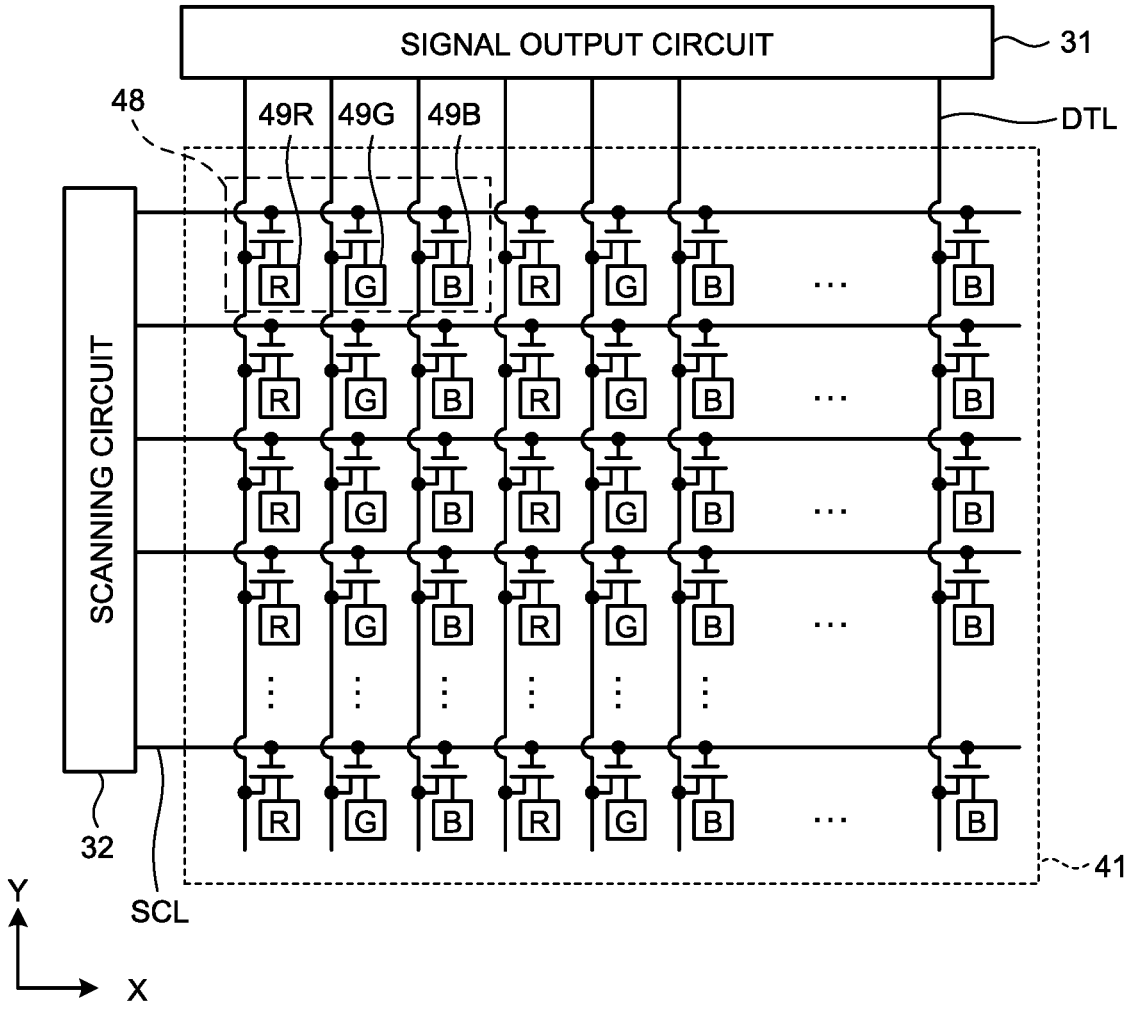
FIG. 2 is a conceptual diagram of an image display panel according to the first embodiment.

FIG. 1 is a block diagram illustrating an exemplary configuration of a display device 10 according to a first embodiment. FIG. 2 is a conceptual diagram of an image display panel 40 according to the first embodiment. As illustrated in FIG. 1, the display device 10 of the first embodiment includes a signal processor 20, an image display panel driver 30, the image display panel 40, and a light source unit 60. The signal processor 20 performs predetermined data conversion processing on input image signals (red-green-blue (RGB) data) from an image transmitter 12 of a controller 11 to generate signals, and transmits the generated signals to components of the display device 10. The image display panel driver 30 controls driving of the image display panel 40 based on the signals from the signal processor 20. The light source unit 60 illuminates the image display panel 40 from a back surface side thereof. The image display panel 40 displays an image using the signals from the image display panel driver 30 and the light from the light source unit 60.

Describing the above by way of a more specific example, the image display panel 40 displays a frame image on an image display surface 41 for displaying an image. In the first embodiment, the input image signals representing respective RGB gradation values of a plurality of pixels constituting one frame image are received as a collective unit by the signal processor 20 within a predetermined period. The signal processor 20 outputs output signals and control signals based on the input image signals so as to display the frame image on the image display panel 40 within a predetermined one frame period. The control signals are signals for controlling operation of the light source unit 60. The light source unit 60 operates in accordance with the control signals under the control of the signal processor 20 and emits light having brightness required for the frame image displayed by the image display panel 40 from a light-emitting area 61 having a size corresponding to the image display surface 41. When input signals for one screen that serve as a basis for the frame image include gradation values assigned to a plurality of pixels, light having brightness required for a pixel assigned with the maximum gradation value to obtain luminance corresponding to the maximum gradation value is referred to as the "light having brightness required for the frame image". To obtain the light having the brightness required for the frame image, the signal processor 20 performs dimming processing of uniformly adjusting the light of the entire light-emitting area 61 or performs local dimming processing of adjusting the light from the light-emitting area 61 in units made up of a plurality of partial areas.

A plurality of pixels 48 are arranged in a two-dimensional matrix (row-column configuration) on the image display surface 41 of the image display panel 40. In this manner, the image display panel 40 serves as a display unit having the pixels 48. FIG. 1 illustrates an example in which the pixels 48 are arranged in a matrix (row-column configuration) in a two-dimensional XY-coordinate system. In this example, the X-direction corresponds to the row direction, and the Y-direction corresponds to the column direction. However, the X- and Y-directions are not limited thereto. The X-direction may correspond to the vertical direction, and the Y-direction may correspond to the horizontal direction.

Each of the pixels 48 includes at least two of a first sub-pixel 49R, a second sub-pixel 49G, and a third sub-pixel 49B. The first sub-pixel 49R displays a first color (such as red). The second sub-pixel 49G displays a second color (such as green). The third sub-pixel 49B displays a third color (such as blue). The first color, the second color, and the third color are not limited to red, green, and blue. The first to third colors may be any colors different from one another, such as complementary colors. In the following description, when the first sub-pixel 49R, the second sub-pixel 49G, and the third sub-pixel 49B are not necessary to be distinguished from one another, each of them will be called a sub-pixel 49. In other words, one sub-pixel 49 is assigned with any one of the three colors.

The image display panel 40 of the first embodiment is a transmissive color liquid crystal display panel. In the image display panel 40, a first color filter for transmitting the first color is disposed between the first sub-pixel 49R and an image viewer. In the image display panel 40, a second color filter for transmitting the second color is disposed between the second sub-pixel 49G and the image viewer. In the image display panel 40, a third color filter for transmitting the third color is disposed between the third sub-pixel 49B and the image viewer.

The image display panel driver 30 includes a signal output circuit 31 and a scanning circuit 32. The image display panel driver 30 uses the signal output circuit 31 to hold the output signals, and to sequentially output them to the image display panel 40. More in detail, the signal output circuit 31 outputs image signals having predetermined potentials corresponding to the output signals from the signal processor 20 to the image display panel 40. The signal output circuit 31 is electrically coupled to the image display panel 40 through signal lines DTL. The scanning circuit 32 controls on and off of switching elements for controlling operations (light transmittance) of the sub-pixels 49 in the image display panel 40. The switching elements are, for example, thin-film transistors (TFTs). The scanning circuit 32 is electrically coupled to the image display panel 40 through scanning lines SCL.

The light source unit 60 is disposed on the back surface side of the image display panel 40. The light source unit 60 emits the light toward the image display panel 40 to illuminate the image display panel 40.

As illustrated in FIG. 1, the signal processor 20 is a circuit on which circuit portions corresponding to various functions, such as a luminance rise determiner 21, a timer circuit 22, a light source controller 23, and an image analyzer 24, are mounted. Components of the signal processor 20 and the image display panel driver 30 are provided on the image display panel 40 using, for example, a chip-on-glass (COG) technique. However, this is merely a specific configuration example of the signal processor 20 and the image display panel driver 30. The configuration thereof is not limited to this example and can be changed as appropriate.

The luminance rise determiner 21 determines the degree of rise in luminance of the light emitted by the light source unit 60. Hereinafter, the luminance of the light emitted by the light source unit 60 is referred to as the luminance of the light source unit 60. Specifically, the luminance rise determiner 21 determines whether the light source unit 60 has operated so as to raise the luminance of the light by a predetermined amount of luminance change or more within a first predetermined time WT1. The first predetermined time WT1 is, for example, a period of time equal to or longer than a first transition time UT (refer, for example, to FIG. 3) required for the luminance of the light source unit 60 to change from 0% to 100%. The state where the luminance of the light is 0% refers to, for example, a state where the light source unit 60 does not emit the light, or emits the light at the minimum luminance. The state where the luminance of the light is 100% refers to, for example, a state where the light source unit 60 emits the light at the maximum luminance. More specifically, the first predetermined time WT1 is set to a period of time with a length within a range from 0.1 seconds to 0.2 seconds, for example. However, this setting is merely an example of the first predetermined time WT1, which is not limited thereto and can be changed as appropriate.

The timer circuit 22 manages time related to processing performed by the signal processor 20. Specifically, the timer circuit 22 includes, for example, a timer serving as a clock and a counter for managing an elapsed time from a certain time point.

The light source controller 23 controls the operation of the light source unit 60 depending on the brightness required for the frame image. For example, when the light source unit 60 has operated so as to raise the luminance of the light by the predetermined amount of luminance change or more within the first predetermined time WT1, the light source controller 23 controls the operation of the light source unit 60 so as not to lower the luminance of the light source unit 60 for a second predetermined time or longer. Specifically, the second predetermined time is, for example, a period of time that is set to a period of time with a length within a range from 0.1 seconds to 10 seconds. The second predetermined time may be set to a period of time with a length within a range from 1.1 seconds to 5 seconds. However, this setting is merely an example. The second predetermined time is not limited thereto and can be changed as appropriate.

The image analyzer 24 analyzes the frame image based on the input image signals. Specifically, the image analyzer 24 determines the luminance of the light source unit 60 required for displaying the frame image, for example, based on the RGB gradation values represented by the input image signals corresponding to the pixels 48 constituting the frame image. As a specific example, if the RGB gradation values of all the pixels constituting the frame image are RGB=(0, 0,0), the frame image is a black image, that is an image in which all the pixels are black. In this case, the light from the light source unit 60 is not required. Accordingly, in this case, the image analyzer 24 sets the luminance of the light source unit 60 that operates depending on the display of the frame image to 0%. If one or more of the RGB gradation values of one or more pixels constituting the frame image is or are each an upper limit value corresponding to the number of bits of each of the RGB gradation values, such as 255 in the case of 8-bit gradation, the frame image needs to be illuminated by the light at the maximum luminance. Accordingly, in this case, the image analyzer 24 sets the luminance of the light source unit 60 that operates depending on the display of the frame image to 100%. In the other cases, the image analyzer 24 sets the luminance of the light source unit 60 that operates depending on the display of the frame image to luminance required for display output of the highest gradation value in the frame image. The other cases refer to cases where the highest gradation value of the RGB gradation values of the pixels constituting the frame image is a value higher than zero and lower than the upper limit value corresponding to the number of bits of each of the RGB gradation values, such as a value within a range from 1 to 254 in the case of 8-bit gradation.

In the first embodiment, the light source controller 23 controls the operation of the light source unit 60 to cause the luminance of the light source unit 60 to achieve the luminance determined by the image analyzer 24. However, this is merely an example of the specific configuration, and the light source controller 23 is not limited thereto. The light source controller 23 may have the above-described function of the image analyzer 24.

The light source controller 23 controls the operation of the light source unit 60 such that the falling rate of the luminance is lower than the rising rate of the luminance. For example, the falling time of the luminance of the light source unit 60 is set to a period of time within a range of 10 to 100 times longer than the rising time of the luminance. As a more specific example, if the first transition time UT is from 0.1 seconds to 0.2 seconds, the light source controller 23 controls the operation of the light source unit 60 such that a second transition time is equal to a time within a range from three seconds to four seconds. The first transition time UT is a period of time taken for the luminance of the light source unit 60 to rise from substantially 0% to substantially 100%. The second transition time is a period of time taken for the luminance of the light source unit 60 to fall from substantially 100% to substantially 0%. The first transition time UT corresponds to the rising rate or the rising time of the luminance. The second transition time corresponds to the falling rate or the falling time of the luminance. The ratio between the rising rate and the falling rate can be represented by the ratio between the rising time, which is the time taken for the luminance to rise from a first luminance (such as 0%) to a second luminance (such as 100%), and the falling time, which is the time taken for the luminance to decrease from the second luminance to the first luminance. In other words, in this specific example, the falling time of the luminance is 30 to 40 times longer than the rising time of the luminance.

Figure 3:
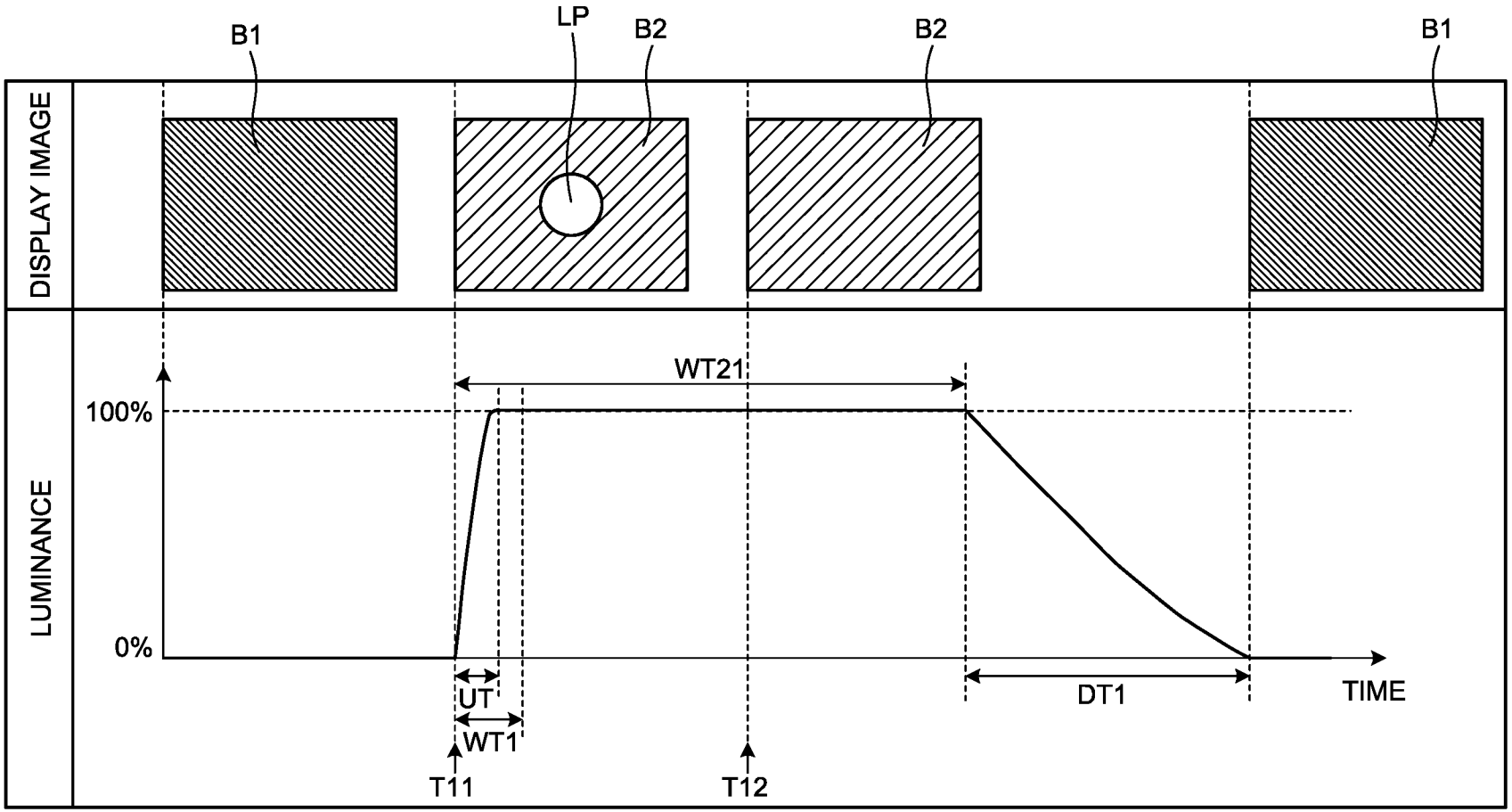
FIG. 3 is a chart explaining an exemplary relation between a display image on an image display surface changing with lapse of time and luminance of a light source unit.

The following describes a relation between a change in a display image on the image display surface 41 and the luminance control of the light source unit 60. FIG. 3 is a chart explaining an exemplary relation between the display image on the image display surface 41 changing with lapse of time and the luminance of the light source unit 60. In FIG. 3 and other figures, in order to distinguish black B1 from black B2, the black B1 and the black B2 are illustrated by being hatched differently from each other. The black B1 is black obtained when the luminance of the light source unit 60 is substantially 0%, and the black B2 is black obtained around a high luminance area LP when the luminance of the light source unit 60 is not substantially 0% (such as 100%). The RGB gradation values of pixels included in the image area of the black B1 is the same as those of pixels included in the image area of the black B2 (for example, RGB=(0, 0,0)). The high luminance area LP is an area including a pixel or pixels in which at least one of the RGB gradation values is the upper limit value. Hereinafter, an image including the high luminance area LP is referred to as a high luminance requiring image.

For example, the light source controller 23 sets the luminance of the light source unit 60 to 0% during a period in which the display image is a black image. As a result, the black of the black image is set to the black B1 obtained when the luminance of the light source unit 60 is substantially 0%. Then, at time T11 at which the display image is changed to the high luminance requiring image, the light source controller 23 sets the luminance of the light source unit 60 to 100%. The luminance of the light source unit 60 changes from substantially 0% to substantially 100% through the first transition time UT. The amount of luminance change associated with the transition of the luminance from 0% to 100% is the maximum amount of change in the luminance of the light source unit 60. Therefore, the luminance rise determiner 21 determines that the light source unit 60 has operated so as to raise the luminance of the light by the predetermined amount of luminance change or more within the first predetermined time WT1. Accordingly, the light source controller 23 controls the operation of the light source unit 60 so as not to lower the luminance of the light source unit 60 for a second predetermined time WT21 or longer. Specifically, for example, at time T11, the timer circuit 22 sets the counter for measuring time until the second predetermined time WT21 elapses. The value of the counter is incremented as the time measured by the timer included in the timer circuit 22 increases. The light source controller 23 controls the operation of the light source unit 60 so as not to lower the luminance of the light source unit 60 until the value of the counter reaches a value representing the lapse of the second predetermined time WT21. In other words, prevention of the lowering of the luminance of the light from the light source unit 60 is given priority over the dimming processing until the second predetermined time WT21 elapses. As a result, of the control operations for the light from the light source unit 60 depending on the gradation values of the input signals, the light control operation for lowering the brightness of the light from the light source unit 60 is disabled until the second predetermined time WT21 elapses.

As illustrated in FIG. 3, even when the display image is changed from the high luminance requiring image to the black image at time T12 before the second predetermined time WT21 elapses, the light source controller 23 does not lower the luminance of the light source unit 60 at time T12. The light source controller 23 keeps the luminance of the light source unit 60 at 100% until the second predetermined time WT21 elapses from time T11. In other words, even when time T12, at which a request for lowering the luminance of the light source unit 60 is made in the case where the luminance is assumed to follow the display image, comes during the second predetermined time WT21, the light source controller 23 controls the operation of the light source unit 60 so as not to lower the luminance of the light source unit 60 until the second predetermined time WT21 elapses. As a result, the black of the black image is the same as the black B2 around the high luminance area LP in the display image before time T12 until the second predetermined time WT21 elapses.

After the second predetermined time WT21 elapses from time T11, if the display image does not require the luminance of the light source unit 60 kept during the second predetermined time WT21, the light source controller 23 lowers the luminance of the light source unit 60. In FIG. 3, the display image after time T12 is the black image. Accordingly, the light source controller 23 changes the luminance of the light source unit 60 from substantially 100% to substantially 0% over a second transition time DT1. This operation changes the black of the black image from the black B2 to the black B1 during the second transition time DT. The transition from the black B2 to the black B1 during the lapse of the second transition time DT is slower than the transition from the black B1 to the black B2 during the lapse of the first transition time UT, thus being a milder change. This operation can restrain a change in the level of black floating from being visible during the fall of the luminance of the light source unit 60. The black floating is a non-true black state on a display screen when a black image is displayed, i.e., the image still has high brightness even though the image is supposed to be black.

Figure 4:
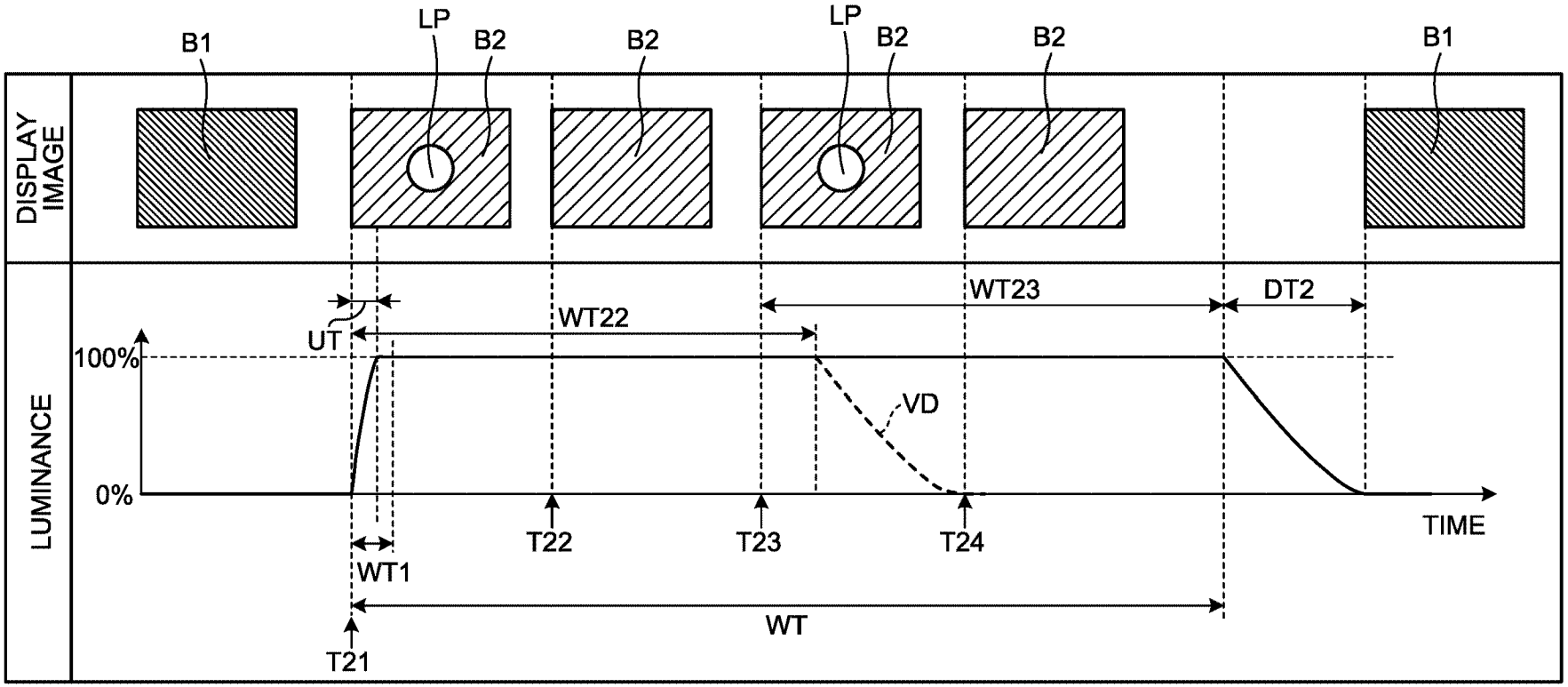
FIG. 4 is a chart explaining another exemplary relation between the display image on the image display surface changing with lapse of time and the luminance of the light source unit.
Figure 5:
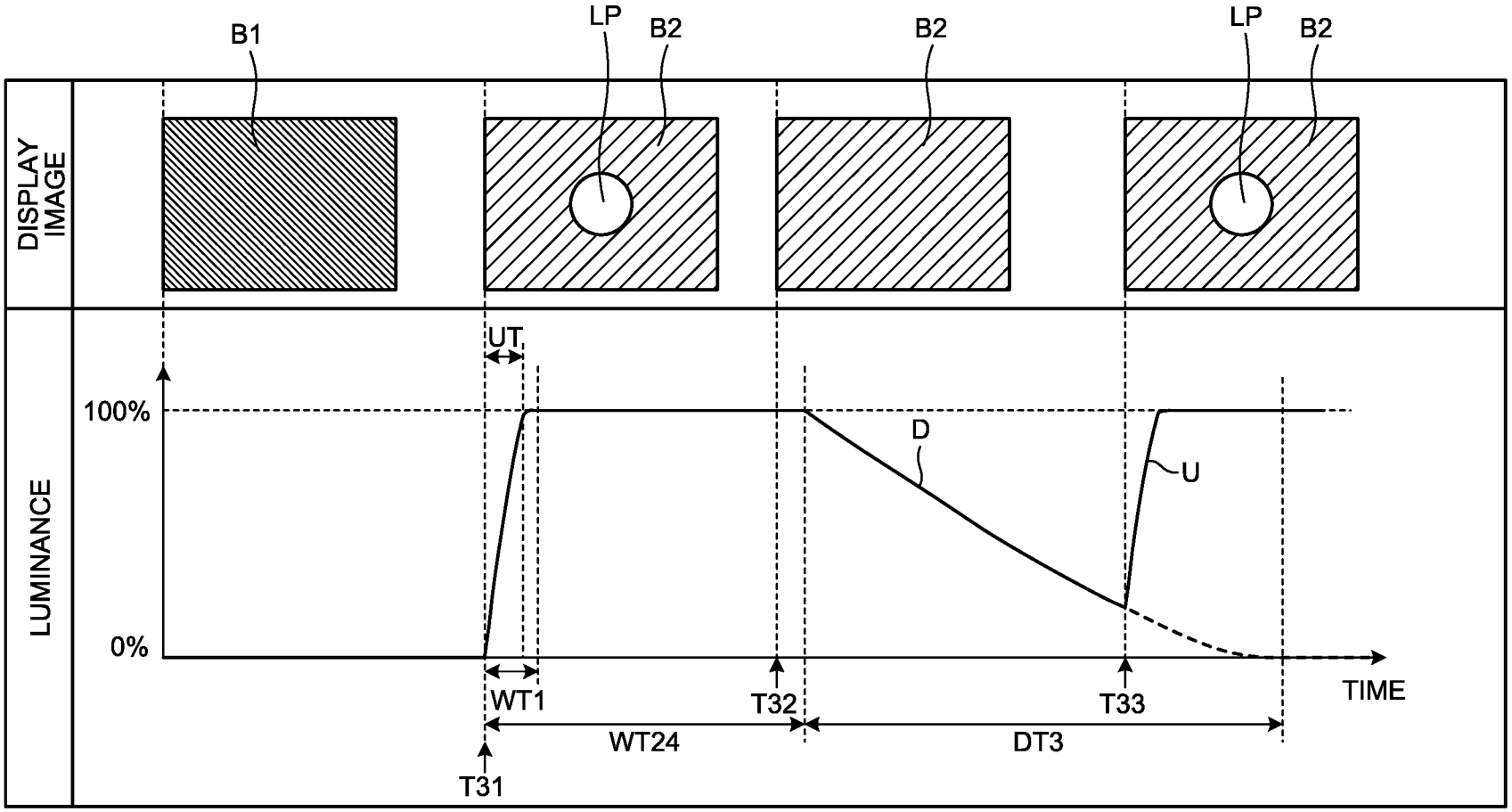
FIG. 5 is a chart explaining still another exemplary relation between the display image on the image display surface changing with lapse of time and the luminance of the light source unit.
Figure 6:
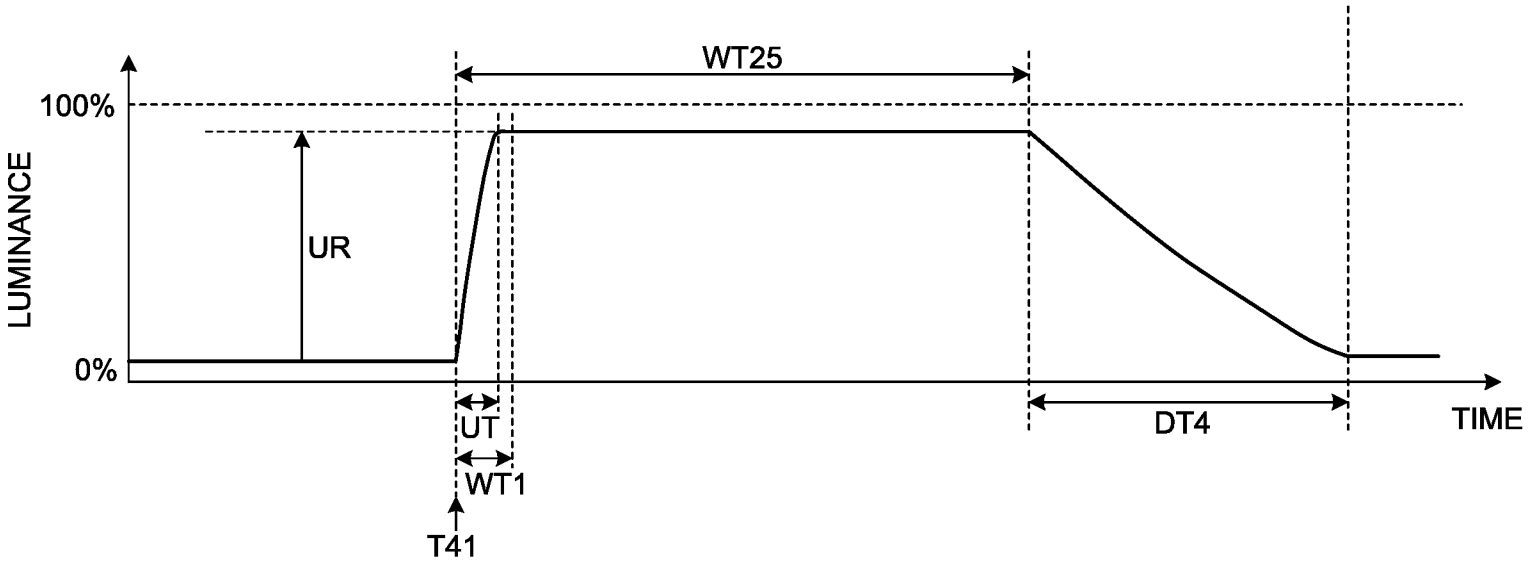
FIG. 6 is a chart explaining an example of the luminance of the light source unit changing within a range above 0% and below 100%.

In FIG. 3 and in FIG. 10 to be explained later, reference numeral WT21 is assigned to the second predetermined time. In FIGS. 4, 5, and 6 to be explained later, reference numerals WT22, WT23, WT24, and WT25 are assigned to the second predetermined time. These second predetermined times WT21, WT22, WT23, WT24, and WT25 represent the same length of time. These differences in reference numerals are merely for distinguishing the explanations with reference to the drawings without confusion, and do not indicate that the second predetermined time is changed depending on the pattern of transition of the display image.

In FIG. 3 and in FIG. 10 to be explained later, reference numeral DT1 is assigned to the second transition time. In FIGS. 4 and 5 to be explained later, reference numerals DT2 and DT3 are assigned to the second transition time. These second transition times DT1, DT2, and DT3 represent the same length of time. These differences in reference numerals are merely for distinguishing the explanations with reference to the drawings without confusion, and do not indicate that the second transition time is changed depending on the pattern of transition of the display image.

FIG. 4 is a chart explaining another exemplary relation between the display image on the image display surface 41 changing with the lapse of time and the luminance of the light source unit 60. In the same manner as in the example of FIG. 3, the light source controller 23 sets the luminance of the light source unit 60 to 0% during the period in which the display image is the black image. As a result, the black of the black image is the black B1 obtained when the luminance of the light source unit 60 is substantially 0%. Then, at time T21 at which the display image is changed to the high luminance requiring image, the light source controller 23 sets the luminance of the light source unit 60 to 100%. Accordingly, in the same manner as in the example of FIG. 3, the light source controller 23 controls the operation of the light source unit 60 so as not to lower the luminance of the light source unit 60 for the second predetermined time WT22 or longer.

In the first embodiment, if a request for lowering and a request for raising the luminance are made within the second predetermined time WT22, the start timing of the second predetermined time is reset in response to the request for raising the luminance. The second predetermined time WT23 in FIG. 4 represents the second predetermined time after the reset. For example, when the display image is changed from the high luminance requiring image to the black image at time T22 before the second predetermined time WT22 elapses, the request for lowering the luminance of the light source unit 60 is made. The light source controller 23 does not, however, lower the luminance of the light source unit 60 at time T22. Then, when the display image is changed to the high luminance requiring image at time T23 before the second predetermined time WT22 elapses, the request for raising the luminance of the light source unit 60 is made. This request for raise is a request for raise with respect to the luminance of the light source unit 60 in accordance with the request for lowering made at time T22. Accordingly, the light source controller 23 resets the start timing of the second predetermined time at time T23, and starts counting time for the second predetermined time WT23. As a result, in FIG. 4, a time WT exceeds the second predetermined time WT22, the time WT being a period of time during which the luminance of the light source unit 60 is not lowered. The time WT is a period of time obtained by adding a period of time until time T23 is reached during the second predetermined time WT22 started at time T21 to the second predetermined time WT23 that is reset and started at time T23. The black of the black image during the time WT is the black B2. In this manner, under the situation where the request for lowering the luminance of the light source unit 60 and the request for raising the luminance are repeated, the start timing of the second predetermined time is reset in response to the request for raising the luminance, and thereby, the change in the level of the black floating can be restrained from being visible.

Even when the display image is changed from the high luminance requiring image to the black image at time T24 before the second predetermined time WT23 that is reset at time T23 elapses, the light source controller 23 does not lower the luminance of the light source unit 60 at time T24. After the second predetermined time WT23 elapses from time T23, if the display image does not require the luminance of the light source unit 60 kept during the second predetermined time WT23, the light source controller 23 lowers the luminance of the light source unit 60. This operation changes the black of the black image from the black B2 to the black B1 during the second transition time DT2.

Assuming a case where the display image is not changed to the high luminance requiring image at time T23, the luminance of the light source unit 60 is lowered after the second predetermined time WT22 started at time T21 elapses. FIG. 4 illustrates the fall of the luminance of the light source unit 60 in this assumption with a dashed line VD.

FIG. 5 is a chart explaining still another exemplary relation between the display image on the image display surface 41 changing with the lapse of time and the luminance of the light source unit 60. In the same manner as in the examples of FIGS. 3 and 4, the light source controller 23 sets the luminance of the light source unit 60 to 0% during the period in which the display image is the black image. As a result, the black of the black image is set to the black B1 obtained when the luminance of the light source unit 60 is substantially 0%. Then, at time T31 at which the display image is changed to the high luminance requiring image, the light source controller 23 sets the luminance of the light source unit 60 to 100%. Accordingly, in the same manner as in the example of FIG. 3, the light source controller 23 controls the operation of the light source unit 60 so as not to lower the luminance of the light source unit 60 for the second predetermined time WT24 or longer.

In the example illustrated in FIG. 5, since the display image is the black image at a time after the second predetermined time WT24 has elapsed from time T31, the light source controller 23 starts lowering the luminance to change the luminance of the light source unit 60 from 100% to 0% over the second transition time DT3. When the display image is changed to the high luminance requiring image at time T33 during the second transition time DT3, the luminance of the light source unit 60 is required to be 100%. In this case, at time T33, the light source controller 23 sets the luminance of the light source unit 60 to 100%. This operation causes a rise U of the luminance to begin at time T33 during a fall D of the luminance. In this manner, since the fall of the luminance is gradual, the difference in luminance can be smaller when the luminance is falling but then suddenly starts rising again. In other words, the change in the level of the black floating associated with the repetition of the fall and rise of the luminance can be restrained from being visible.

Although not illustrated in FIG. 5, the start timing of the second predetermined time is reset at time T33. The reason for this is the following. The change of the display image from the high luminance requiring image to the black image causes the request for lowering the luminance to be made at time T32, and then, the change of the display image from the black image to the high luminance requiring image causes the request for raising the luminance to be made at time T33.

On the assumption that the high luminance area LP is an area including a pixel or pixels in which at least one of the RGB gradation values is the upper limit value, the exemplary case has been described where the luminance of the light source unit 60 is requested to be 0% or 100% depending on the frame image. However, the luminance control of the light source unit 60 is not limited to this exemplary case. The predetermined amount of luminance change may be smaller than the amount of luminance change associated with the transition of the luminance from substantially 0% to substantially 100%. Although the predetermined amount of luminance change is, for example, an amount of luminance change of 70% or higher, this range is merely an example. The predetermined amount of luminance change is not limited thereto and can be changed as appropriate.

FIG. 6 is a chart explaining an example of the luminance of the light source unit 60 changing within a range above 0% and below 100%. As illustrated in FIG. 6, in the case where the luminance starts changing at time T41 from luminance of above 0% to luminance of below 100%, if an amount of luminance change UR is equal to or larger than the predetermined amount of luminance change, the light source controller 23 does not lower the luminance of the light source unit 60 for the second predetermined time WT25 or longer. After the second predetermined time WT25 elapses from time T41, if the display image does not require the luminance of the light source unit 60 kept during the second predetermined time WT25, the light source controller 23 lowers the luminance of the light source unit 60 over a transition time DT4.

Although not illustrated, even in the case of changing the luminance of substantially 0% to below 100%, or in the case of changing the luminance of above 0% to substantially 100%, the light source controller 23 does not lower the luminance of the light source unit 60 for the second predetermined time or longer if the amount of luminance change is equal to or larger than the predetermined amount of luminance change.

Figure 7:
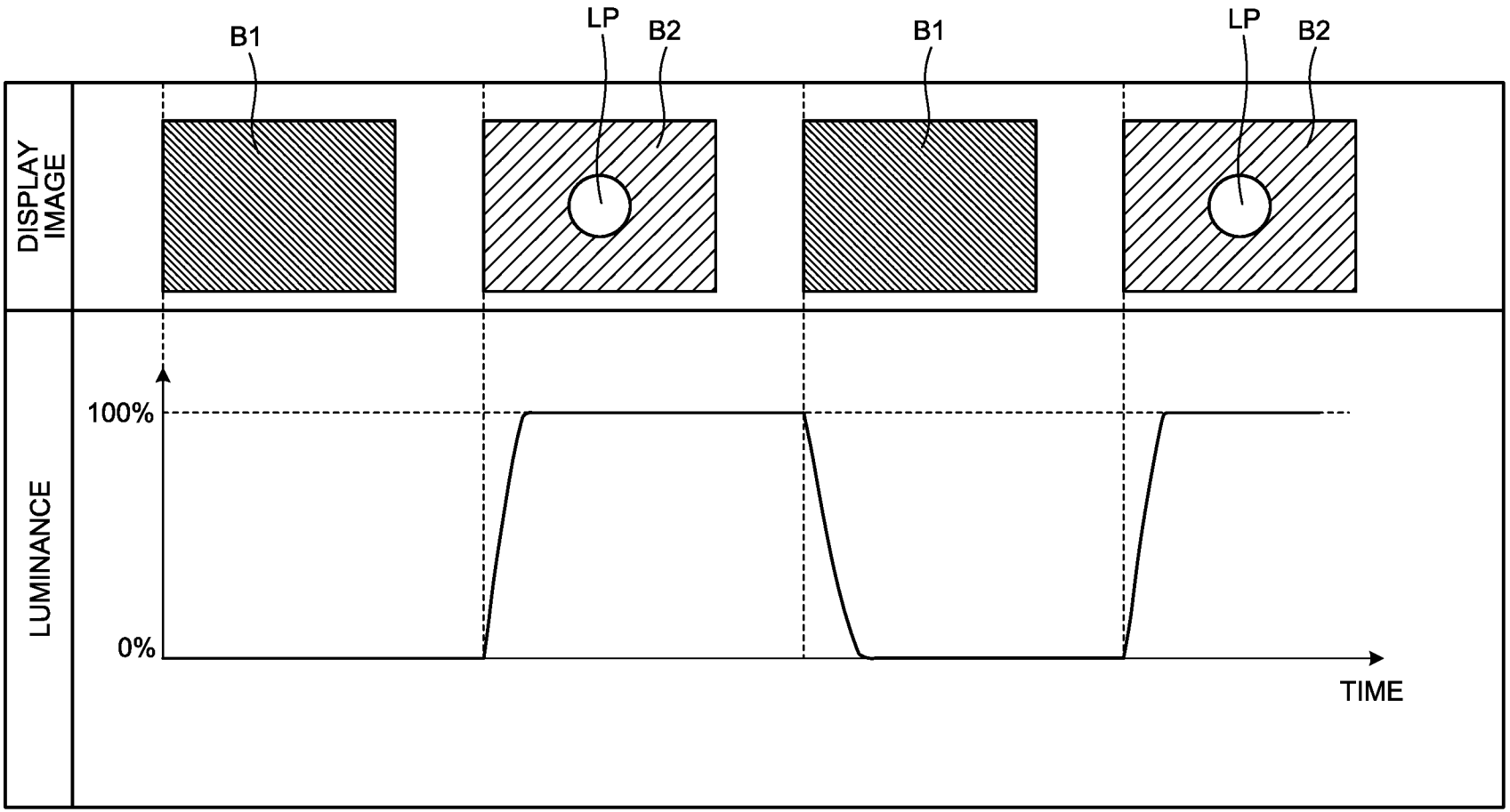
FIG. 7 is a chart illustrating a comparative example in which the luminance rises and falls in real time depending on changes in the display image.

FIG. 7 is a chart illustrating a comparative example in which the luminance rises and falls in real time depending on changes in the display image. Unlike in the case of the display device 10 of the present disclosure, in the comparative example, the luminance of the light source unit 60 is raised at the timing at which the display image is changed from the black image to the high luminance requiring image, and the luminance of the light source unit 60 is lowered at the timing at which the display image is changed from the high luminance requiring image to the black image. As a result, the change in the level of the black floating is visible, the change in the level of the black floating being a phenomenon that, when screen transition occurs in which the display image is changed from the high luminance requiring image to the black image and then changed to the high luminance requiring image again, the black included in the display image during the screen transition is displayed as the black B2 while the high luminance requiring image is displayed, and is displayed as the black B1 while the black image is displayed. In contrast, as described with reference to FIGS. 3 to 6, the display device 10 can restrain the change in the level of the black floating from being visible.

The description with reference to FIGS. 3 to 5 has been made by exemplifying the display image on the entire image display surface 41 and the illumination by the light from the entire light-emitting area 61. However, this is not limited to this example. The same control may be applied, for example, to a part of each of the image display surface 41 and the light-emitting area 61.

Figure 8:
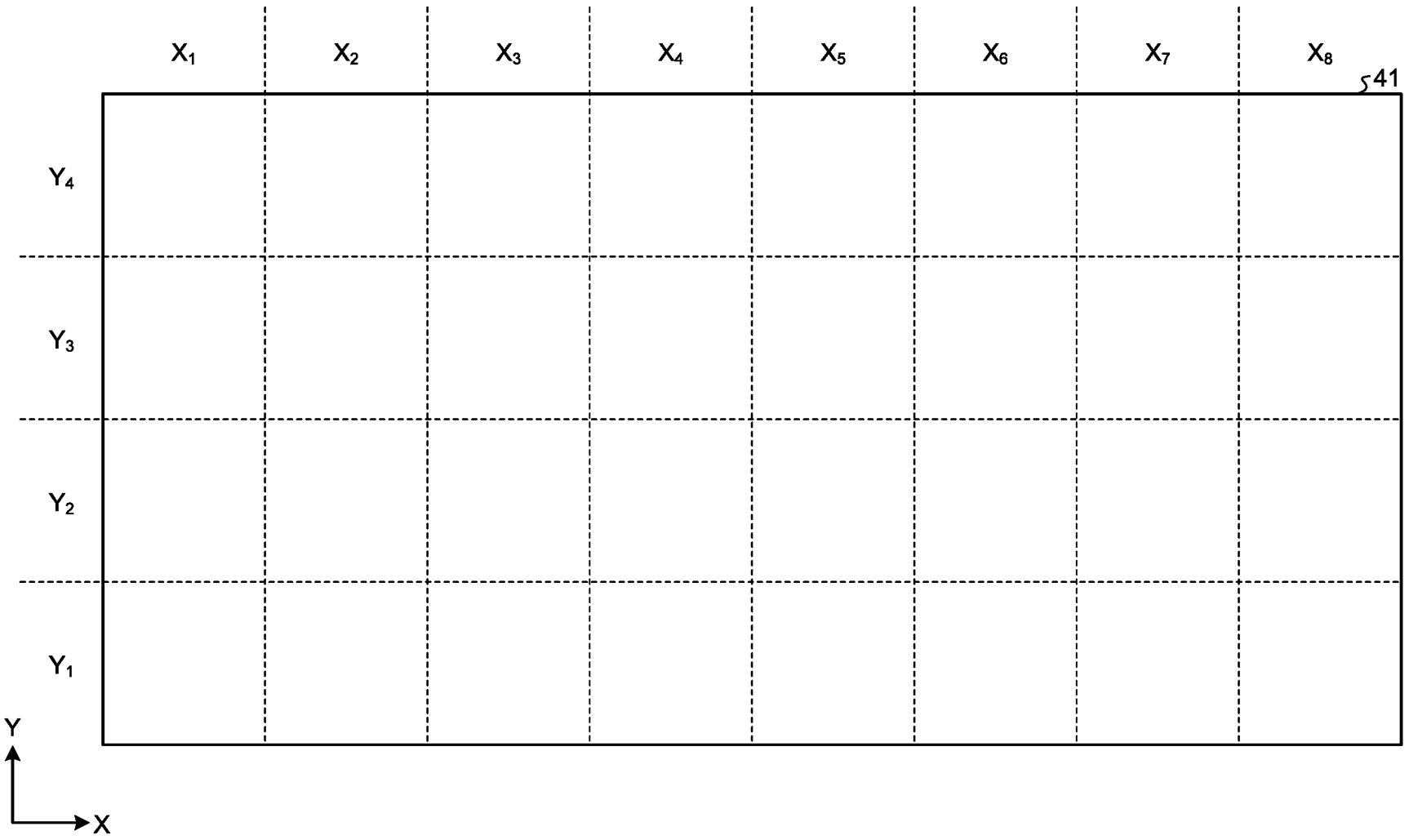
FIG. 8 is a diagram illustrating an example of segmentation of the image display surface.

FIG. 8 is a diagram illustrating an example of segmentation of the image display surface 41. The image display surface 41 is segmented into a plurality of partial areas. Specifically, as illustrated, for example, in FIG. 8, the image display surface 41 is divided into eight equal parts of $X_1$, $X_2$, . . . , and $X_8$ along the X-direction, and divided into four equal parts of $Y_1$, $Y_2$, $Y_3$, and $Y_4$ along the Y-direction, so that 8×4 partial areas are provided. When, as an example, 800 pixels in the X-direction and 480 pixels in the Y-direction, that is, 800×480 pixels Pix are arranged in a matrix (row-column configuration) on the image display surface 41, one partial area illustrated in FIG. 8 includes 100×120 pixels Pix. The example illustrated in FIG. 8 and the number of the pixels on the image display surface 41 are merely examples.

The segmentation and the number of the pixels on the image display surface 41 are not limited thereto and can be changed as appropriate.

Figure 9:
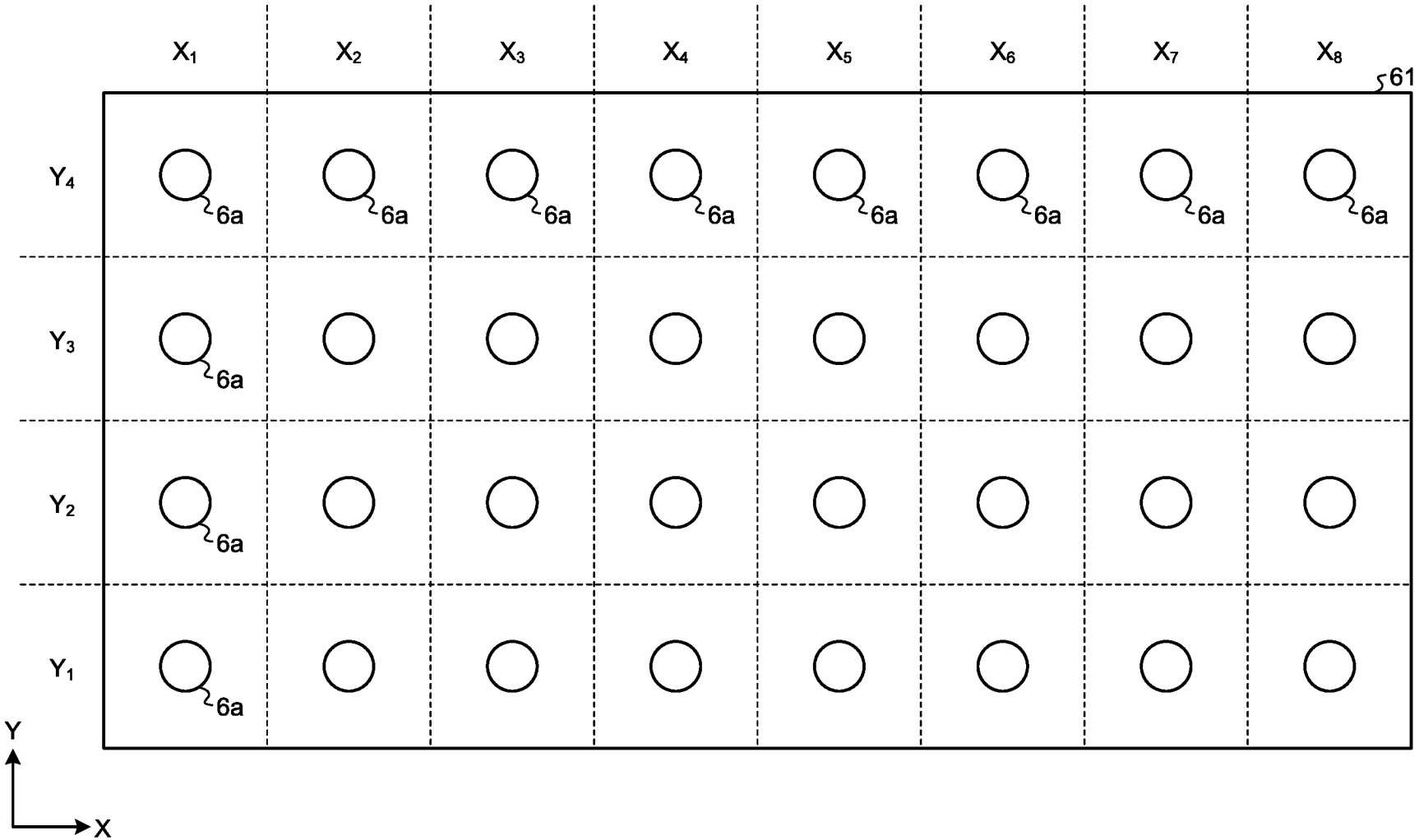
FIG. 9 is a diagram illustrating an exemplary correspondence relation between a plurality of light sources arranged in a light-emitting area and a plurality of partial areas.

FIG. 9 is a diagram illustrating an exemplary correspondence relation between a plurality of light sources 6*a* arranged in the light-emitting area 61 and the partial areas. The arrangement of the light sources 6*a* illustrated in FIG. 9 is an arrangement corresponding to the segmentation into the partial areas illustrated in FIG. 8. The partial areas illustrated in FIG. 8 correspond to the light sources 6*a* included in the light source unit 60. Specifically, as illustrated, for example, in FIG. 9, the light sources 6*a* are disposed such that each of the partial areas is provided with one of the light sources 6*a*. Each of the light sources 6*a* is, for example, a light-emitting diode (LED), which is, however, a specific example of the light source 6*a*. The light source 6*a* is not limited to this example and can be changed as appropriate. In FIG. 9, the light sources 6*a* are disposed such that each of the partial areas is provided with one of the light sources 6*a*. However, the configuration is not limited thereto and may be any configuration in which the light emission quantity of each of the partial areas can individually be controlled and the luminance of each of the partial areas can be individually adjusted. Thus, the configuration can be changed as appropriate. In this manner, the light source unit 60 serving as a light source device in the present disclosure is provided with one or more light sources 6*a* for each of a plurality of light emitters, and the luminance of each light emitter can individually be controlled. The light source controller 23 individually controls the luminance of the light sources 6*a*. As described with reference to FIGS. 3 to 6, the light source controller 23 may uniformly illuminate the image display surface 41 from the back surface side thereof using the light sources 6*a* illustrated in FIG. 9.

Figure 10:
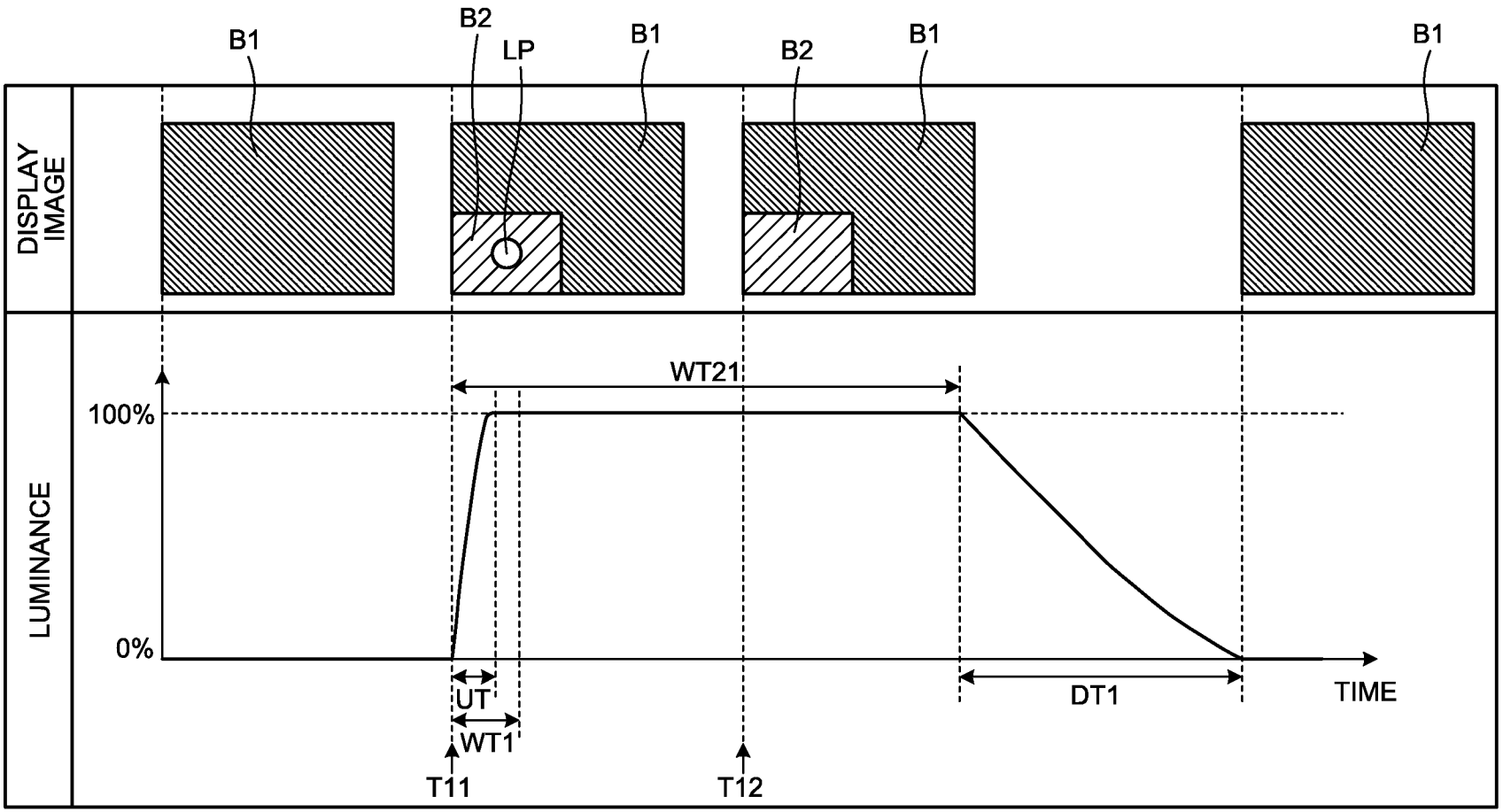
FIG. 10 is a chart explaining an exemplary relation between the display image on the image display surface changing with lapse of time and the luminance of some of the light sources.

FIG. 10 is a chart explaining an exemplary relation between the display image on the image display surface 41 changing with lapse of time and the luminance of some of the light sources. Unlike in FIG. 3, FIG. 10 illustrates a pixel area located on the lower left side of the image display surface 41. In the pixel area, the high luminance area LP is displayed on the black background at time T11, and the high luminance area LP disappears to return the color to black at time T12. Accordingly, partial areas corresponding to the location of the high luminance area LP need to be raised in luminance. The changes in luminance illustrated in the chart of FIG. 10 are changes in luminance of some of the light sources 6*a* corresponding to the partial areas corresponding to the location of the high luminance area LP.

If, as illustrated as the display image at time T11 in FIG. 10, partial areas corresponding to ¼ (on the lower left side) of the image display surface 41 are assumed as the partial areas corresponding to the location of the high luminance area LP, the light sources 6*a* corresponding to partial areas given by combinations of coordinates in the X-direction and coordinates in the Y-direction $(X_1,Y_1)$, $(X_1,Y_2)$, $(X_2,Y_1)$, $(X_2,Y_2)$, $(X_3,Y_1)$, $(X_3,Y_2)$, $(X_4,Y_1)$, and $(X_4,Y_2)$ are to be raised in luminance by the light source controller 23. As a result, at time T11 in FIG. 10, both the black B2 in the partial areas corresponding to the location of the high luminance area LP and the black B1 in the other partial areas are displayed. In addition, the luminance of these light sources 6*a* does not fall until the second predetermined time WT21 elapses. Thus, both the black B2 in the partial areas corresponding to the ¼ (lower left side) of the image display surface 41 and the black B1 in the other partial areas are displayed even after the display image is changed to the black image at time T12. After the second predetermined time WT21 elapses, the entire image display surface 41 is set to the black B1 through the second transition time DT1. In other words, in the case of the example illustrated in FIG. 10, the prevention of the lowering of the luminance of the light from the light source unit 60 is given priority over the local dimming processing until the second predetermined time WT21 elapses.

The above description has been made without distinguishing the type of the image displayed on the image display surface 41. However, the type of the image may be limited that is subjected to the control of not lowering the luminance of the light source unit 60 for the second predetermined time or longer if the luminance of the light source unit 60 is raised by the predetermined amount of luminance change or more within the first predetermined time WT1. For example, in the case where a raster image or a ramp image (gradation image) is displayed on the image display surface 41, the light source controller 23 may lower the luminance of the light source unit 60 within a time shorter than the second predetermined time in accordance with the request for lowering the luminance of the light source unit 60 even if the luminance of the light source unit 60 has been raised by the predetermined amount of luminance change or more within the first predetermined time WT1. In this case, for example, the image analyzer 24 determines the type of the image. In other words, the image analyzer 24 serves as a determiner that determines whether the image displayed by the display unit is either of the raster image or the ramp image (gradation image). The image analyzer 24 holds, for example, data to be used for pattern matching for determining the type of the image and determines whether the image is the raster image, the ramp image (gradation image), or another type of image by performing the pattern matching using the data. The term "raster image", as used herein, refers to what is called a solid image in which the same gradation value and/or approximate gradation values thereto uniformly spread. The term "ramp image (gradation image)" refers to an image in which the continuity of a position (coordinates) in the image is related to the continuity of variation in at least either one of the color tone or the brightness of each position.

Figure 11:
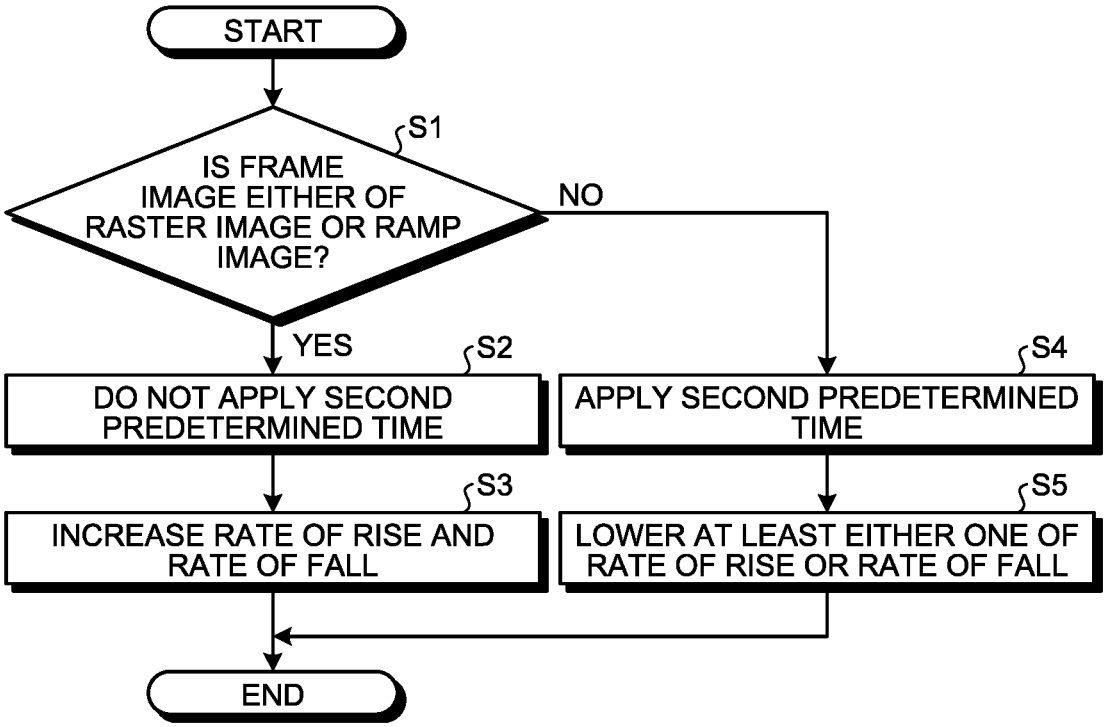
FIG. 11 is a flowchart illustrating exemplary processing in accordance with the type of an image.

FIG. 11 is a flowchart illustrating exemplary processing in accordance with the type of the image. The image analyzer 24 determines whether the frame image constituted by the input image signals is either of the raster image or the ramp image (gradation image) (Step S1). If the frame image is determined to be either of the raster image or the ramp image (gradation image) (Yes at Step S1), the light source controller 23 does not apply the second predetermined time (Step S2). In other words, in the case where either of the raster image or the ramp image (gradation image) is displayed, if the luminance of the light source unit 60 has been raised by the predetermined amount of luminance change or more within the first predetermined time WT1, the light source controller 23 does not apply the control of not lowering the luminance of the light source unit 60 for the second predetermined time or longer. Consequently, in the case where the fall of the luminance occurs in response to the transition of the display image of the frame image, it does not matter whether the second predetermined time has elapsed after the luminance of the light source unit 60 has been raised by the predetermined amount of luminance change or more within the first predetermined time WT1. In this case, the light source controller 23 increases the rising rate and the falling rate of the luminance such that the rates are higher than those of other types of images (Step S3). Specifically, the light source controller 23 controls the rate so as to cause it to follow the rise of the luminance with as quick a response as possible, for example, in accordance with the first transition time UT that is taken for the luminance of the light source unit 60 to rise from substantially 0% to substantially 100%. During the second transition time, the light source controller 23 also controls the rate so as to cause it to follow the fall of the luminance with as quick a response as possible without applying the control to slow the fall as described with reference to FIG. 3. In other words, in the raster image and the ramp image (gradation image), the responsiveness of following the change in luminance is higher than in other types of images. If the frame image is determined to be neither the raster image nor the ramp image (gradation image) (No at Step S1), the light source controller 23 applies the second predetermined time (Step S4). In other words, as described with reference to FIG. 3 and other figures, the light source controller 23 applies the control of not lowering the luminance of the light source unit 60 for the second predetermined time or longer if the luminance of the light source unit 60 has been raised by the predetermined amount of luminance change or more within the first predetermined time WT1. The light source controller 23 lowers at least either one of the rising rate or the falling rate of the luminance (Step S5). Specifically, as described with reference to FIG. 3 and other figures, the light source controller 23 sets the second transition time to a period of time longer than the first transition time UT. The light source controller 23 may apply, as the first transition time, a longer time than the first transition time UT that is achievable in terms of performance. For example, the rising time of the luminance may be 30 to 40 times longer than the first transition time UT described above. In this case, the first predetermined time WT1 is also lengthened depending on the actually applied first transition time, which is longer by, for example, 30 to 40 times.

In the raster image and the ramp image (gradation image), the change in the level of the black floating is less visible than in images, such as photographic images, in which brightness and darkness are likely to coexist. However, when the intensity of the illumination gradually changes, the change is likely to be more visible in the raster image and the ramp image (gradation image) than in the photographic images.

Figure 12:
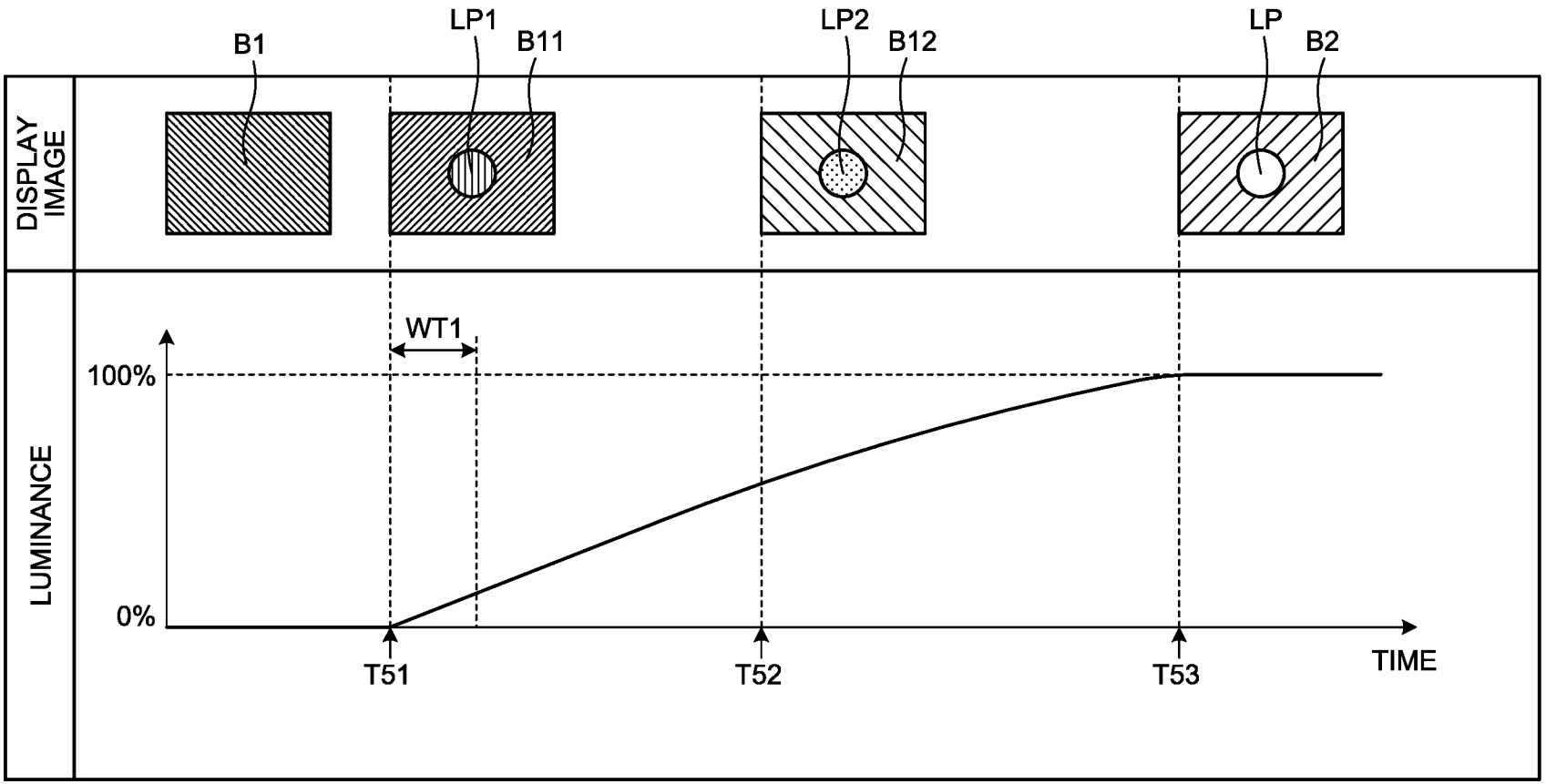
FIG. 12 is a chart explaining an exemplary relation between the display image and the luminance of the light source unit when the light source unit is controlled so as to gradually increase in brightness.

FIG. 12 is a chart explaining an exemplary relation between the display image and the luminance of the light source unit 60 when the light source unit 60 is controlled so as to gradually increase in brightness. As illustrated, for example, in FIG. 12, a case is assumed where the luminance is controlled so as to change from the luminance before the rising (such as 0%) to the luminance after the rising (such as 100%) over a time from time T51 to time T53 exceeding the first predetermined time WT1. In this case, during a period of change from the black B1 before time T51 to the black B2, the black in the display image changes so as to leave an impression of gradually rising in brightness while the brightness of the light from the light source unit 60 has not yet fully risen, as illustrated as blacks B11 and B12 in FIG. 12. The black B11 is black generated at any time between time T51 and intermediate time T52 between time T51 and T53, and is black brighter than the black B1 and darker than the black B12. The black B12 is black generated at any time between intermediate time T52 and time T53, and is black brighter than the black B11 and darker than the black B2. Also in the high luminance area LP, the luminance changes so as to leave an impression of gradually rising in brightness while the brightness of the light from the light source unit 60 has not yet fully risen, as illustrated as intermediate luminance areas LP1 and LP2 in FIG. 12.

As described with reference to FIG. 12, when the intensity of the illumination gradually changes, the change is likely to be more visible in the raster image and the ramp image (gradation image) than in the photographic images. Therefore, the luminance lowering inhibition period after the luminance rise is not applied to the raster image and the ramp image (gradation image), and thereby, the gradual change in intensity of the illumination can be restrained from being apparent, as described with reference to FIG. 11. Since the visibility of the change in the level of the black floating hardly causes a problem in the raster image and the ramp image (gradation image), no problem is caused by omitting the application of the luminance lowering inhibition period after the luminance rise.

As described above, according to the first embodiment, when the light source unit 60 has operated so as to raise the luminance of the light by the predetermined amount of luminance change or more within the first predetermined time WT1, the luminance of the light source unit 60 is not lowered for the second predetermined time or longer. As a result, the change in the level of the black floating can be restrained from being visible.

The light source controller 23 sets the falling time of the luminance to a period of time longer than the rising time of the luminance. As a result, the change in the level of the black floating can be further restrained from being visible.

If the request for lowering and the request for raising the luminance are made within the second predetermined time WT22, the start timing of the second predetermined time WT23 is reset in response to the request for raising the luminance. This operation can more surely restrain the change in the level of the black floating from being visible during the transition of the display image that causes the request for raising and the request for lowering the luminance to be alternately made.

The light source unit 60 includes the light emitters, and the luminance of each light emitter can individually be controlled. This configuration can restrain the change in the level of the black floating from being visible even when what is called the local dimming is employed.

The luminance lowering inhibition period after the luminance rise is not applied to the raster image and the ramp image (gradation image), and thereby, the gradual change in intensity of the illumination can be restrained from being apparent.

In the first embodiment described above, the image analyzer 24 analyzes the frame image. However, the image analyzer 24 and the processing by the image analyzer 24 are not necessary.

Second Embodiment

The display device 10 according to a second embodiment of the present invention has a configuration obtained by eliminating the image analyzer 24 from the configuration of the display device 10 according to the first embodiment illustrated in FIG. 1. In the second embodiment, a change pattern of the frame image is set in advance. In the second embodiment, a series of display images made up of a plurality of frame images provided from the image transmitter 12 of the controller 11 is display images in which the brightness and darkness are repeatedly changed. In other words, the display image is such that, when the luminance of the light source unit 60 follows the display image in real time, the luminance of the light source unit 60 repeatedly rises and falls by the predetermined amount of luminance change or more. Specifically, in the second embodiment, the input image signals are provided that correspond to the series of display images in which, for example, a dark image, such as the black image, and an image including a bright area, such as the high luminance requiring image, are repeatedly switched therebetween.

In the second embodiment, the series of display images is determined in advance. Accordingly, the second predetermined time is set so as not to lower the luminance after the luminance rises with the start of display until the display of the series of display images is completed. In the second embodiment, the second predetermined time only needs to be a period of time exceeding a repetition period of the light-dark cycle in the display image by a factor of one. In the second embodiment, a period of time twice the repetition period of the light-dark cycle is exemplified as a specific example of the second predetermined time. However, this is merely an example. The second predetermined time is not limited thereto and can be changed as appropriate.

In embodiments including the above-described first and second embodiments, the light source controller 23 controls the operation such that the falling time of the luminance of the light source unit 60 is longer than the rising time of the luminance. However, such a control pattern may be set in advance by default in the light source unit 60. In other words, the light source device, such as the light source unit 60, may have a configuration in which the falling time of the luminance is longer than the rising time of the luminance.

Figure 13:
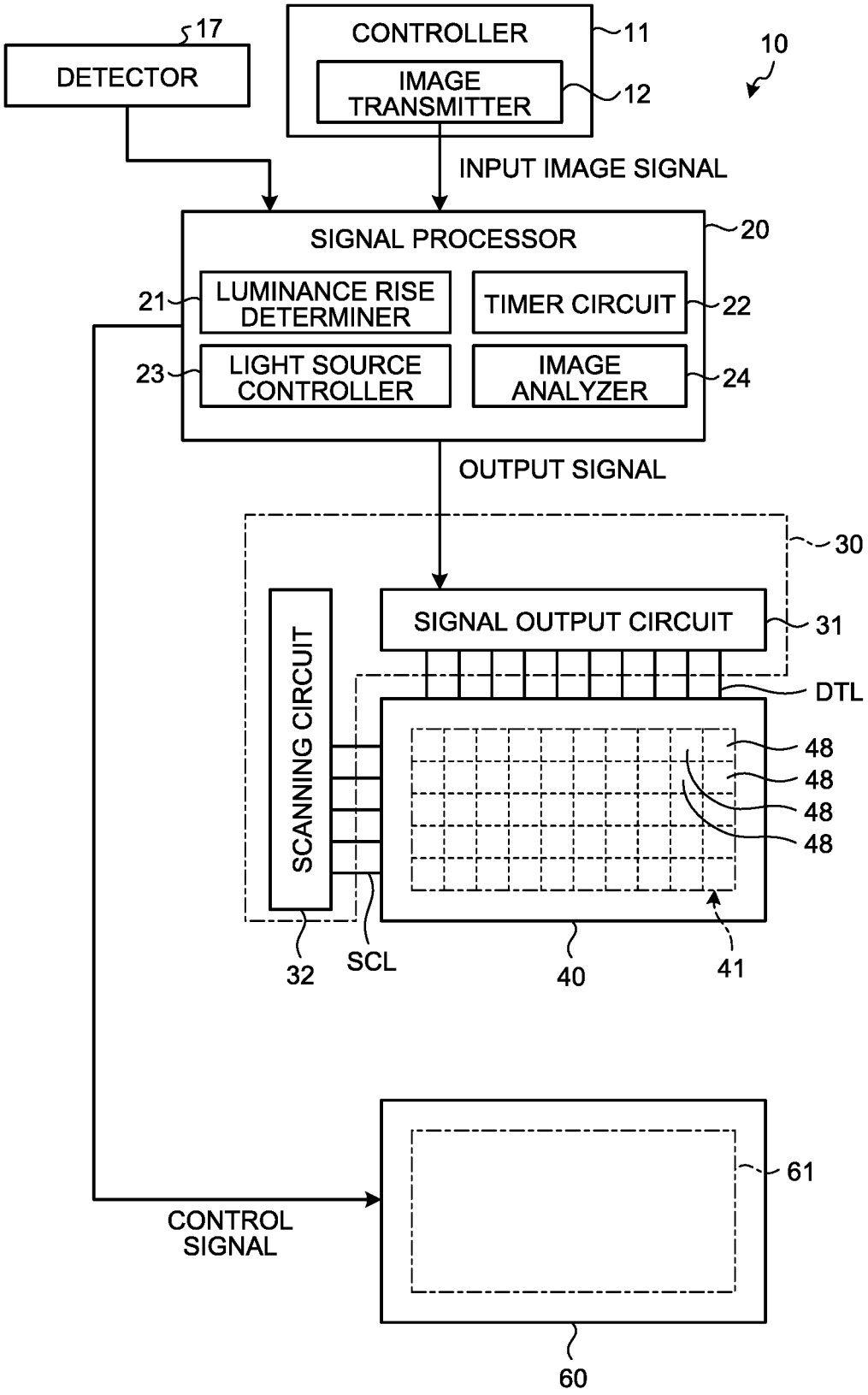
FIG. 13 is a block diagram illustrating an exemplary configuration of the display device that controls the luminance depending on external light.

FIG. 13 is a block diagram illustrating an exemplary configuration of the display device 10 that controls the luminance depending on external light. The "case where the luminance of the light source unit 60 is raised by the predetermined amount of luminance change or more within the first predetermined time WT1" in the embodiments is not limited to the case where a change has occurred in the luminance of the light source unit 60 required depending on the display image based on the input image signals. For example, the display device 10 may have a configuration that includes a detector 17 for detecting the brightness of the external light and has a function to change the level of the illumination provided by the light source unit 60 depending on the brightness of the external light. In this case, for example, the illumination by the light source unit 60 is reduced when the external light is weak (dark), and increased when the external light is strong (bright). Under such a condition where the condition of the external light often changes (for example, a blinking light source, such as a traffic light, is present), if the luminance of the light source unit 60 is once raised by the predetermined amount of luminance change or more within the first predetermined time WT1, the display device 10 may avoid lowering the luminance of the light source unit 60 for the second predetermined time or longer. The detector 17 may be a component outside the display device 10. In this case, a signal representing the brightness of the external light detected by the external detector 17 is entered into the signal processor 20.

If the fact that the condition of the external light often changes is determined in advance, the second predetermined time may be set depending on a changing cycle of the condition of the external light. In this case, the second predetermined time only needs to be a period of time exceeding the changing cycle of the condition of the external light by a factor of one. A period of time twice the changing period of the condition of the external light is exemplified as a specific example. However, this is merely an example. The second predetermined time is not limited thereto and can be changed as appropriate.

Other operational advantages accruing from the aspects described in the embodiments that are obvious from the description herein or that are appropriately conceivable by those skilled in the art will naturally be understood as accruing from the present invention.

What is claimed is:

1. A display device comprising:

a display unit comprising a plurality of pixels;

a light source device configured to emit light that illuminates the display unit;

a controller configured to control operation of the light source device; and a determiner configured to determine whether an image displayed by the display unit is either of a raster image and a ramp image, wherein the controller is configured not to lower luminance of the light for a second predetermined time or longer after the controller has raised the luminance of the light by a predetermined amount of luminance change or more within a first predetermined time, and when either of the raster image and the ramp image is displayed by the display unit, the controller lowers the luminance of the light within a time shorter than the second predetermined time in accordance with a request for lowering the luminance even when the luminance of the light has been raised by the predetermined amount of luminance change or more within the first predetermined time.

2. The display device according to claim 1, wherein the controller is configured to set a falling time of the luminance to a period of time longer than a rising time of the luminance.

3. The display device according to claim 1, wherein the second predetermined time is set to a period of time with a length within a range from 0.1 seconds to 10 seconds.

4. The display device according to claim 1, wherein, when a request for lowering and a request for raising the luminance are made within the second predetermined time, a start timing of the second predetermined time is reset in response to the request for raising the luminance.

5. The display device according to claim 1, wherein the light source device comprises a plurality of light emitters capable of individually controlling the luminance, and each of the light emitters is provided with one or more light sources.

6. A display device comprising:

a display unit comprising a plurality of pixels; and a light source device configured to emit light that illuminates the display unit, wherein a falling time of luminance of the light is longer than a rising time of the luminance of the light, and when either of a raster image and a ramp image is displayed by the display unit, the luminance of the light is lowed within a time shorter than a second predetermined time in accordance with a request for lowering the luminance even when the luminance of the light has been raised by a predetermined amount of luminance change or more within a first predetermined time.

7. The display device according to claim 6, wherein the falling time is set to a period of time within a range of 10 to 100 times longer than the rising time.

* * * * *